US010210848B1

(12) United States Patent
Falcon

(10) Patent No.: US 10,210,848 B1
(45) Date of Patent: Feb. 19, 2019

(54) PICK AND APPLICATOR FOR USE WITH A STRINGED INSTRUMENT

(71) Applicant: Pick Creations, LLC, Glenview, IL (US)

(72) Inventor: Chris Falcon, Glenview, IL (US)

(73) Assignee: Pick Creations, LLC, Glenview, IL (US)

( * ) Notice: Subject to any disclaimer, the term of this patent is extended or adjusted under 35 U.S.C. 154(b) by 0 days.

(21) Appl. No.: 15/885,331

(22) Filed: Jan. 31, 2018

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 1,784,934 A * 12/1930 Johansson ..... G10D 3/163 84/322
4,137,814 A * 2/1979 Rowley ..... G10D 3/163 84/322
4,248,128 A * 2/1981 Des Gaines ..... G10D 3/163 84/322
4,691,609 A * 9/1987 Acocella ..... G10D 3/163 84/322
4,779,778 A * 10/1988 Nixon, II ..... A44C 3/008 224/220
5,942,704 A * 8/1999 Weldon ..... G10D 3/163 84/320
6,118,058 A * 9/2000 Rowley ..... G10D 3/163 84/320
6,133,516 A * 10/2000 Hendrickson ..... G10D 3/163 84/322
6,242,677 B1 * 6/2001 Sander ..... G10D 3/163 84/319
6,903,256 B2 * 6/2005 Pittman ..... G10D 3/163 84/320
9,993,920 B2 * 6/2018 Hatten ..... G10G 7/00
9,997,145 B1 * 6/2018 Rubenstein ..... G10D 3/163
2008/0148920 A1 * 6/2008 Graves ..... G10D 3/163 84/320
2010/0083811 A1 * 4/2010 Gsell ..... G10D 3/163 84/322

* cited by examiner

*Primary Examiner* — Robert W Horn
(74) *Attorney, Agent, or Firm* — Joseph A. Fuchs; Greensfelder, Hemker & Gale, P.C.

(57) ABSTRACT

The present invention provides a device for contacting a set of strings of a stringed instrument. The device has a body with a pick on a first end and an applicator on a second end.

20 Claims, 3 Drawing Sheets

PICK AND APPLICATOR FOR USE WITH A STRINGED INSTRUMENT

CROSS-REFERENCE TO RELATED APPLICATIONS

N/A

FEDERALLY SPONSORED RESEARCH OR DEVELOPMENT

N/A

FIELD OF THE INVENTION

The present invention provides a pick and an applicator for use with a stringed instrument, and more particularly a guitar pick combined with a writing implement.

DESCRIPTION OF THE PRIOR ART

A pick or plectrum is commonly used for striking the strings of a stringed instrument such as an electric guitar, an acoustic guitar, a bass guitar, a mandolin or other stringed instrument known to musicians. The pick is typically a thin piece of plastic or other material shaped like a pointed teardrop or triangle. The size, shape, width, thickness, gauge, weight, density, stiffness, and hand feel may vary considerably. Guitar picks are made of a variety of materials, including celluloid, metal, rubber, felt, tortoiseshell, wood, metal, glass, tagua, stone and plastic. A plastic delrin is the most common material used today.

SUMMARY OF THE INVENTION

The present invention provides a device for contacting a set of strings of a stringed instrument. The device has a body with a pick on a first end and an applicator on a second end. The pick has a cross-sectional shape of a straight line, a wavy line, an arcuate line, a polygon, a circle, an oval, a slanting line, a convex line, a concave line, to name a few. A portion of the pick has a grip-enhancing agent, preferably located on an outer surface of the pick. The grip enhancing agent can be a tacky material or a surface feature such as an uneven surface, a concave indentation or a plurality of protuberances, for example.

The applicator can be placed in fluid communication with a substance such as an ink, a dye, a stain, a paint, a chemical, an acid, a base, graphite, chalk, clay, ash, or a plastic. Preferably, the applicator is a writing implement such as a pen, a pencil, a marker, or other type of writing implement well known to those of ordinary skill in the art. The applicator has a surface contact portion of metal, metal alloy, stainless steel, bronze, brushed nickel, copper, wood, stone, rubber, plastic, acrylic polymer, hair, glass, foam, wood, cellulose, bone or felt. The body can be molded or assembled from two or more parts.

The assembly can include a member for connecting the pick to the applicator. The connection can be rigid, permanent, removable, flexible, pivotal, or telescoping.

BRIEF DESCRIPTION OF THE DRAWINGS

To understand the present invention, it will now be described by way of example, with reference to the accompanying drawings in which.

DETAILED DESCRIPTION

Figure 1:
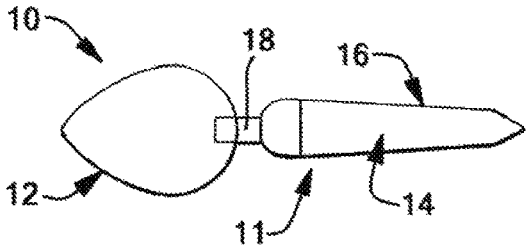
FIG. 1 is a perspective view of a device of the present invention of a pick and an applicator.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows one embodiment of a device 10 having a body 11 with a pick 12 at one end, an applicator 14 at an opposed end, an optional grip-enhancer 16, and an optional member 18 for connecting the pick 12 to the applicator 14. The body 11 can be a single piece of unitary construction or an assembly of two or more parts. The unitary construction is meant to apply to articles that are formed in a molding process or in a series of molding processes or in a cutting or carving process.

For example, molding processes are meant to include both thermoplastic and thermosetting techniques and typically require a step of heating a plastic material and a step of molding the heated material into a desired shape using a mold. Injection molding and thermoforming are two examples of suitable processes. The molding process can also include the step of forming the pick and the applicator in separate molding steps and then using a connecting process to connect the items together so that they cannot be separated without destroying or damaging the body 11. It is contemplated using well known polymer processing techniques, for example, overmolding, multi-material-, multi-component-, multi-shot-injection molding as possible techniques in forming a body of unitary design. Thus, a unitary design does not require a homogeneity in material in the body or does it require that all parts be formed at the same time or location. However, a unitary design requires that the device cannot be disassembled into separate parts without destroying or damaging the device or rendering the parts incapable of reassembly.

Thus, a unitary design also is meant to include parts joined by an adhesive to form a permanent bond between or among the parts. For example, a pick 12 and an applicator 14 can be glued together by applying an adhesive material to form a permanent connection. Suitable adhesives are wide ranging but can include single part or multiple part adhesives. Suitable adhesives include, but are not limited to, for example, acrylics, acetates, vinyl acetates, vinyl acrylates, cyanoacrylates, white craft glue, yellow wood glue, spray adhesives, hot glue, wax, or other tacky substance capable of connecting the parts for their use as a pick and as an applicator.

Figure 2:
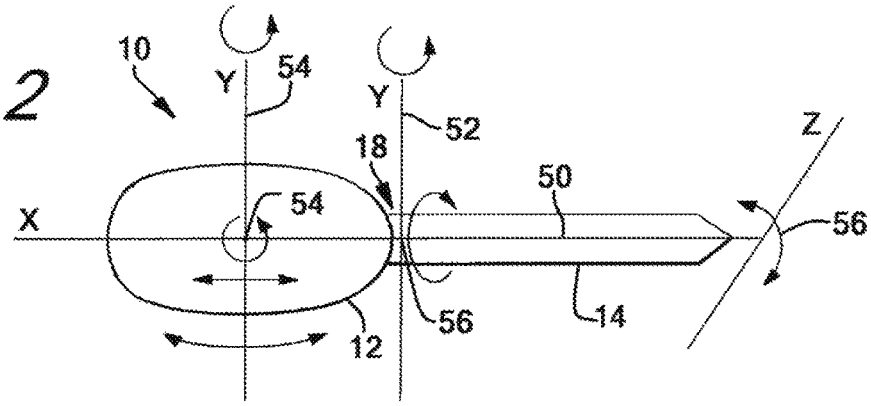
FIG. 2 is a perspective view of the device showing several axes of rotation and lines of transverse movement of the parts relative to one another.

In another preferred form of the invention, the body 11 is an assembly of two or more parts connected with a member for connecting 18 the pick 12 to the applicator 14. An assembly includes parts permanently connected or releasably connected. An assembly includes parts that are connected to allow for relative movement of the parts. FIG. 2 shows examples of relative motion between the pick 12 and the applicator 14 (shown without the optional grip-enhancer 16). Relative motion includes rotational motion about an axis, translational motion along a line, and reciprocating translational motion along a line (the last two will be collectively referred to hereafter as "translational motion"). FIG. 2 shows X, Y and Z axes of rotation including an X axis of rotation 50 extending through a central portion of the pick and the applicator. FIG. 2 also shows two Y axes of rotation 52 and 54. Y axis 52 extends through the connection member 18 at the junction of the pick and the applicator. Y axis 54 extends through a central portion of the pick 12 and transverse to a surface of the pick. FIG. 2 also shows a Z axis of rotation 56 extending perpendicular to the plane of the paper. The Z axis 56 intersects with the X axis 50 and the Y-axis 52 through the connecting member 18 and movement about the Z axis is shown to the right of the figure.

Figure 3A:
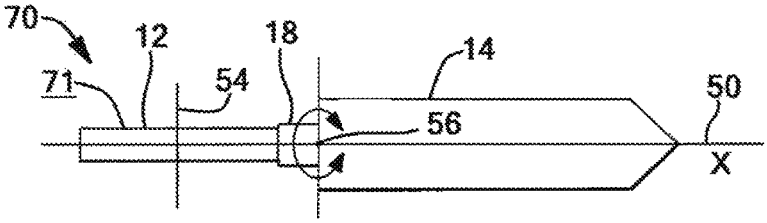
FIGS. 3A,B,C show a side elevational view of the pick respectively in neutral, positive, and negative angular orientation about the Z-axis with respect to the applicator.
Figure 3B:
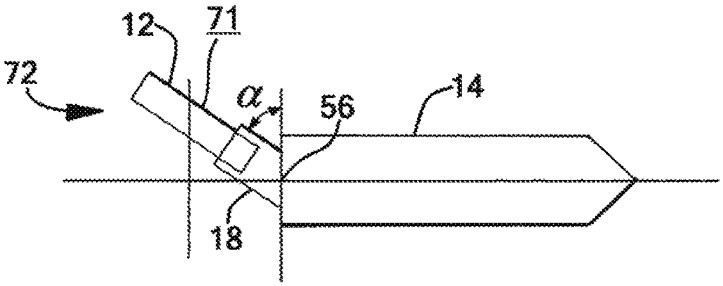
Figure 3C:
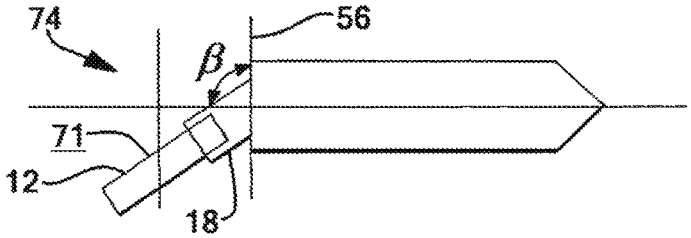

FIGS. 3A,B,C show rotation of the pick 12 about axis 56 among a neutral position 70 (FIG. 3A), a positive position 72 (FIG. 3B) where an upper surface 71 of the pick 12 forms an angle $\alpha$ with the X-axis 50, and a negative position 74 where the upper surface 71 form an angle $\beta$ with the X-axis 50 (FIG. 3C). The angle $\alpha$ should be within the range of 1-45°, more preferably from 1-30° or any range or combination of ranges therein. Angle $\alpha$ is shown at about 30° which could be the maximum position depending on the configuration of the member for connecting 18, which will be discussed in greater detail below. Thus, the invention contemplates connecting the parts in a manner so that these angle ranges can be partially or fully achieved. The angle $\beta$ should have the same numerical range as angle $\alpha$ but with a negative sign.

Figure 4A:
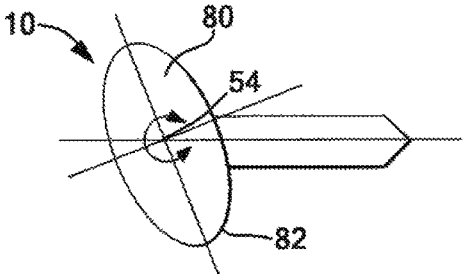
FIGS. 4A,B show a top plan view of a pick at different angular orientations about the Y-axis with respect to the applicator.

FIGS. 4A,B show rotation of pick 12 about axis 54 shown in two different degrees of rotation about axis 54. The pick 12 is shown with two lobes 80,82 in different angular orientations about axis 54. While the axis of rotation 54 is shown generally centrally disposed on the pick, it is contemplated that the axis 54 could be disposed at any location along the outer surface of the pick. In a preferred form of the invention, the pick is capable of rotation through a complete 360° range of rotation. The degree of rotation can be infinitely positionable, or it can be indexed for rotation in n-degree increments where n can be from 5° to 180°.

Figure 5A:
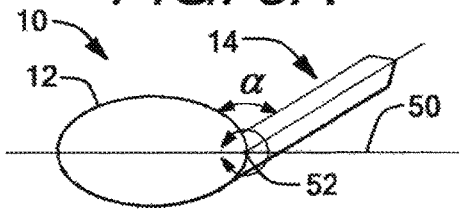
FIGS. 5A,B show the applicator respectively at a positive and a negative rotational orientation about the Y-axis with respect to the pick.
Figure 4B:
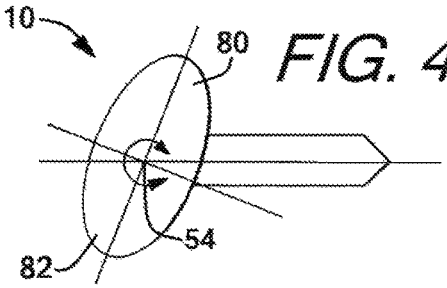
Figure 5B:
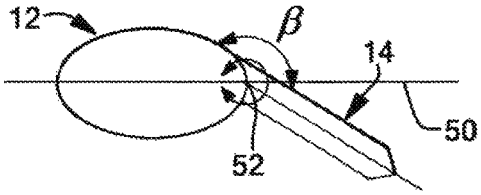

FIGS. 5A,B shows the device 10 with the pick 12 and the applicator 14 disposed at a positive angle $\alpha$ (FIG. 5A) and at a negative angle $\beta$ (FIG. 5B) about axis 52. The angle $\alpha$ should be within 1-90° and the angle $\beta$ should have the same range of angles but the negative thereof.

Figure 6A:
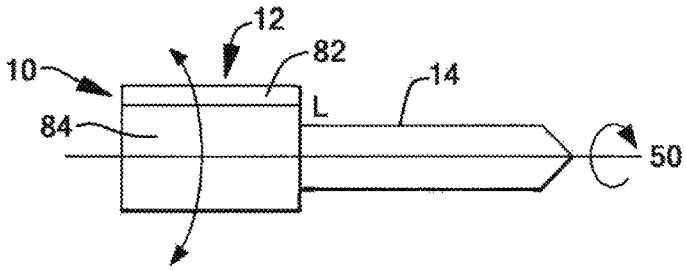
FIGS. 6A,B show the pick at two different angles of orientation about the X-axis.
Figure 6B:
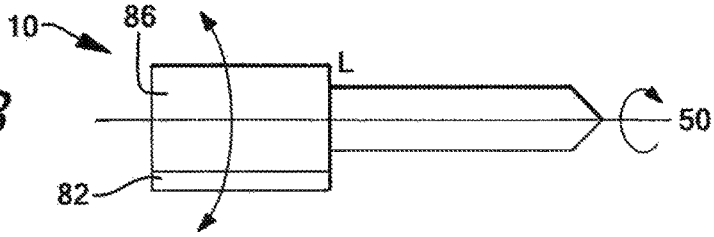

FIGS. 6A,B show the device 10 with the pick and applicator 14 at different angles of orientation about axis 50. In this example, the applicator remains stationary and the pick is rotated about the axis 50. The pick has an edge 82 (thickness), an upper planar surface 84 and a lower planar surface 82. FIG. 6A,B shows the pick disposed 180° from one another or the obverse and reverse respectively. In a preferred form of the invention, the pick is capable of rotation through a complete 360° range of rotation about axis 50. The degree of rotation can be infinitely positionable, or it can be indexed for rotation in n-degree increments where n can be from 5° to 180°.

Figure 7A:
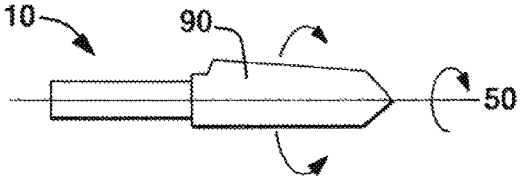
FIGS. 7A,B show the applicator at two different angles of orientation about the X-axis.
Figure 7B:
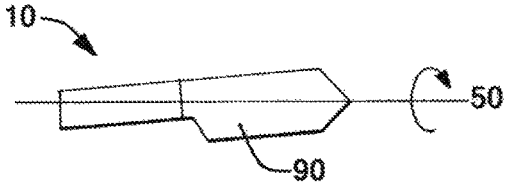

FIGS. 7A,B show the device 10 with the pick 12 and the applicator 14 at different angles of orientation about axis 50. In this example, the pick remains stationary and the applicator 14 is rotated about the axis 50. The applicator 14 is shown with a ridge 90 disposed 180° from one another on a positive side and a negative side of axis 50, respectively shown in FIGS. 7B,7B. The ridge is shown to render the pen asymmetrical about axis 50 so that its orientation about the X-axis 50 is clear.

Figure 8A:
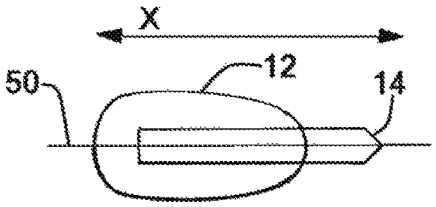
FIGS. 8A,B show the pick and applicator mounted for translational movement along the X-axis 50.

As for the relative translational movement of the pick 12 and the applicator 14, the parts can be connected together for motion along the X-axis 50, the Y-axis 52, or the Z-axis 56. FIGS. 8A,B show the pick respectively in a minimum position and a maximum position along axis 50. The parts can be mounted for sliding engagement to achieve this end as will be discussed in greater detail below.

Figure 9A:
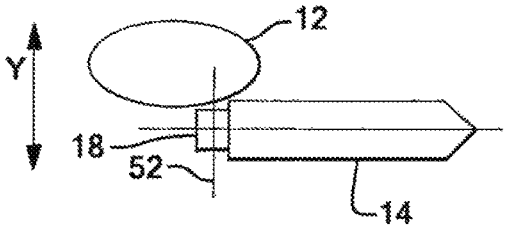
FIGS. 9A,B,C show the pick mounted for translational motion along the Y-axis respectively from a first orientation, a neutral orientation and a second orientation.

FIGS. 9A,B,C respectively show the pick in a maximum, neutral, and minimum position along Y-axis 52 with respect to the applicator 14. The parts can be mounted for sliding engagement to achieve this end as will be discussed in greater detail below.

Figure 10:
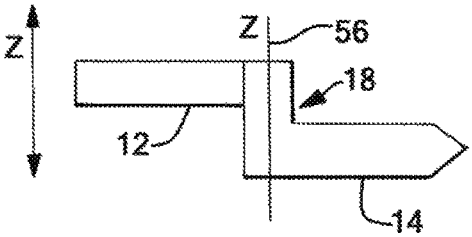
FIG. 10 shows the pick mounted for translational motion along the Z-axis.

FIG. 10 shows the pick 12 in a maximum position along the Z-axis 56. The neutral and minimum positions should be clear in view of the above-discussed examples.

Now to describe the pick 12, the applicator 14, the grip enhancer 16, and the member for connecting 18. Picks are typically a thin piece of material shaped like a pointed teardrop, a triangle, a circle, an oval, a polygon, and numerous other shapes. A pick is meant to be held in a hand of a user and brought into engagement with strings, and, therefore has a gripping portion and a string-contacting portion, although they may not be designated as such. The size, shape, width, thickness, gauge, weight, density, stiffness, and hand feel may vary considerably. Guitar picks are made of a variety of materials, including celluloid, metal, rubber, felt, tortoiseshell, wood, metal, glass, tagua, stone and plastic. A plastic delrin is the most common material used today.

The pick 12 can have a variety of shapes in cross section including a straight line, in the case of a pick having a planar surface. The pick can have other cross-sectional shapes such as a wavy line, an arcuate line, a polygon, a circle, an oval, a slanting line, a convex line, a concave line, for example. Some picks available for purchase have a grip-enhancing agent, preferably located on an outer surface of the pick. The grip enhancing agent can be a tacky material or a surface feature such as an uneven surface, a concave indentation, ergonomic grooves, ergonomic grooves to promote correct finger placement, or a plurality of protuberances, for example. The tacky material or the surface of the pick can have an uneven surface that is textured, such as a matte finish, or have a plurality of upstanding protuberances, or inwardly extending indentations.

The applicator 14 will have a hand-gripping portion, a surface contact portion, and optionally a source of fluid in fluid communication with the surface contact portion. The source of fluid could also be retained within a separate container such as an ink well. The applicator applied the fluid is applied on a surface in the form of e.g., written words, letters, notes; for viewing or reading by a user of the device or other person. In a preferred form of the invention, the fluid is a liquid such as an ink, a dye, a stain, a paint, a chemical, an acid, a base, graphite, chalk, clay, ash, a plastic, for example. Preferably, the applicator 14 is a writing implement such as a pen, a pencil, a marker, or other type of writing implement well known to those of ordinary skill in the art. Preferably, the pen will have a barrel defining a chamber that houses an ink container that is in fluid contact with the surface contact portion.

The applicator has a surface contact portion of metal, metal alloy, stainless steel, bronze, brushed nickel, copper, wood, stone, rubber, plastic, acrylic polymer, hair, glass, foam, wood, cellulose, bone or felt. Suitable pens include fountain pens, quills, roller balls, ball points, and other types of pens well known to those of skill in the art. The writing tips of the pens can have a cap, or can be deployed from an inner chamber of a pen body with plunger or by rotation of a portion of the pen body. Suitable pens can include those sold by Bic, Write Brothers, Paper Mate, Parker, Cross, Mont Blanc to name a few well known examples.

Suitable pencils include standard wood pencils with graphite of any hardness, mechanical pencils where the graphite is deployed by a plunger or by rotation or relative movement of one pencil part with respect to another pencil part. Suitable wood pencils include Dixon Ticonderoga, for example. Suitable mechanical pencils are sold by Staedtler.

Suitable markers include dry erase markers, permanent markers, felt-tip markers, highlighters, graphic markers, paint brushesand other type of markers well known to those of skill in the art.

Suitable grip-enhancing features 16 can be a part of the applicator body or can be a separate piece applied to the applicator body. It is known to provide various surface features on an outside of an applicator, and particularly to an outside barrel of a pen, such as protuberances, bumps, cross hatching, cushioning (possibly applied by overmolding of a soft material), facets and other surface feature in an attempt to improve the quality and the comfort of a grip. Grip enhancing features that are separate include elastomeric sleeves that are slid over the pen barrel to grip the pen barrel, and stick and spray adhesives that are applied to an outer surface of the pen barrel.

Connecting members 18 include hardware to connect the pick to the applicator to allow for relative movement of the parts as described above. Movement of the pick 12 about the Z-axis 56 with respect to the applicator 14 as shown in FIGS. 3A,B,C, can be achieved using a hinge that allows for movement between the positions described above can include an elastomeric sleeve that grips a portion of the pick at one end and the applicator an opposed end. This allows for ease of movement of the parts in a hand of a user into a comfortable position and to return to its original position when in a non-use position. The elastomeric sleeve can also be configured to be positioned and retained in a desired orientation until moved by a user. This can be achieved using accordion folding a portion of the sleeve much the same as bendable drinking straws.

Rotation of the pick 12 about axis 54 as shown in FIGS. 4A,B can be accomplished by placing an axle or pin through concentric through holes in the parts to allow the pick to be rotated freely, or through indexed angles, about the pin axle.

Rotation of the applicator 14 about axis 52 as is shown in FIGS. 5A,B can be accomplished using the hinge, and more particularly the elastomeric sleeve as described above with respect to FIGS. 3A,B,C.

Rotation of the pick 12 about X-axis 50, while the applicator 14 is stationary, as is shown in FIGS. 6A,B, can be accomplished using a swiveling connector that can rotate freely about 360° or from indexed positions separated by 1°, more preferably by 15°, even more preferably 30°, or other greater angle such as 45°, 60°, 90°, or 180°.

Rotation of the applicator 14 about X-axis 50 while the pick 12 stationary as is shown in FIGS. 7A,B, can be accomplished using a swiveling connector that can rotate freely about 360° or from indexed positions separated by 1°, more preferably by 15°, even more preferably 30°, or other greater angle such as 45°, 60°, 90°, or 180°.

Figure 8B:
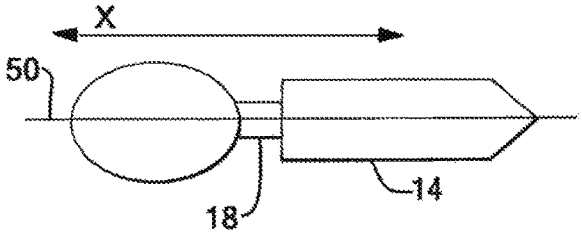

Relative translational movement of the parts along the X-axis 50 is shown in FIGS. 8A,B. Such motion allows for adjustment of the length of the device from a shortest condition (FIG. 8A) to a longest condition (FIG. 8B) and can include a telescoping series of rods or other suitable mechanism.

Figure 9B:
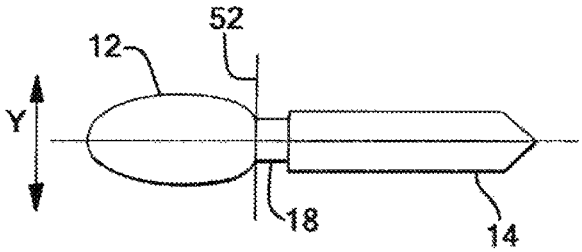
Figure 9C:
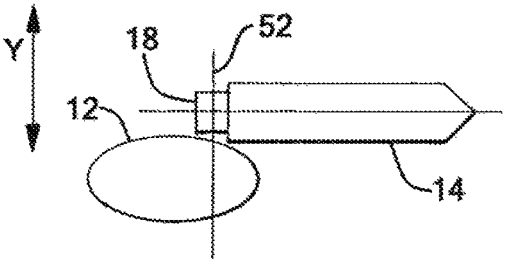
Figure 11:
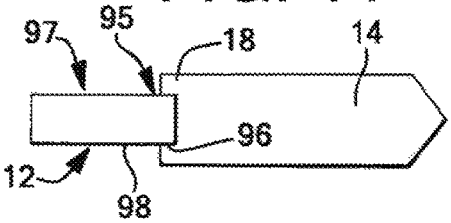
FIG. 11 shows a side elevational view of a device with a slot in the connecting member.

FIGS. 9A,B,C show relative translational movement of the pick along the Y-axis 52 from a first side orientation (FIG. 9A), to a neutral position (FIG. 9B), to a second side orientation (FIG. 9C). FIG. 11 shows the connecting member 18 with a slot 95 for slidably receiving a peripheral edge 96 of the pick to allow the pick to be slid among these positions and those therebetween. The slot 95 can form an interference fit with the obverse 97 and reverse 98 surfaces of the pick 12. The connecting member can also include a lock (not shown) moveable from a locked position, where the parts are prevented from movement, to an unlocked position, where the parts are free to move or to be moved in response to pressure applied by a user. A locking clamping mechanism such as locking vice grip plyers is contemplated having a pair of opposed jaws that can be moved by a mechanism to change the distance between the jaws to grip the pick or to release the pick.

Translational motion along the Z-axis 56 as shown in FIG. 10 can include a slot 95 in the connection member 18 which would extend vertically as shown, that allows adjustment along the vertical direction and further to allow locking the device in the desired location along the vertical path.

It is also contemplated using releasable fastening mechanisms such as a quick release mechanism commonly used on valet keychains.

Many modifications and variations of the present invention are possible in light of the above teachings. It is, therefore, to be understood within the scope of the appended claims the invention may be protected otherwise than as specifically described.

I claim:

1. A device for contacting a set of strings of a stringed instrument comprising:

a body having a first end and a second end, a pick on the first end of the body and an applicator on the second end of the body, the pick having a first gripping portion and a string contacting portion.

2. The device of claim 1 wherein the pick has a cross-sectional shape of a straight line, a wavy line, an arcuate line, a polygon, a circle, an oval, a slanting line, a convex line, and a concave line.

3. The device of claim 1 wherein a portion of the pick has a grip-enhancing agent.

4. The device of claim 3 wherein the grip enhancing agent is located on an outer surface of the pick.

5. The device of claim 4 wherein the grip enhancing agent comprises a tacky material.

6. The device of claim 5 wherein the tacky material has an uneven surface.

7. The device of claim 6 wherein the uneven surface comprises a plurality of protuberances.

8. The device of claim 2 wherein the first grip-enhancing feature comprises a surface feature of the pick.

9. The device of claim 8 wherein the surface feature is a concave indentation or ergonomic groove.

10. The device of claim 1 wherein the applicator is in fluid communication with a substance selected from the group consisting of an ink, a dye, a stain, a paint, a chemical, an acid, a base, graphite, chalk, clay, ash, and a plastic.

11. The device of claim 1 wherein the applicator is a writing implement.

12. The device of claim 11 wherein the writing implement is selected from the group consisting of a pen, a pencil, and a marker.

13. The device of claim 1 wherein the applicator has a surface contact portion of metal, metal alloy, stainless steel, bronze, brushed nickel, copper, wood, stone, rubber, plastic, acrylic polymer, hair, glass, foam, wood, cellulose, bone or felt.

14. The device of claim 1 wherein the applicator has a surface contact portion that is blunt, sharp, pointed, arcuate, straight, or slanted.

15. The device of claim 1 wherein the body is uniform.

16. The device of claim 15 wherein the body is molded.

17. The device of claim 1 wherein the body is an assembly.

18. The device of claim 17 wherein the assembly further comprises a member for connecting the pick to the applicator.

19. The device of claim 18 wherein the member provides a rigid connection, a permanent connection, a removable connection, a flexible connection, a pivotal connection, or a telescoping connection.

20. The device of claim 1 further comprising a second grip-enhancing feature on the applicator.

* * * * *